US006340054B1

(12) United States Patent
Schwarz et al.

(10) Patent No.: US 6,340,054 B1
(45) Date of Patent: Jan. 22, 2002

(54) PLATE HEAT EXCHANGER

(75) Inventors: Gebhard Schwarz, Stuttgart; Hans-Dieter Schwarz, Bretzfeld; Martin Wührl, Tamm, all of (DE)

(73) Assignee: Behr GmbH & Co., Stuttgart (DE)

( * ) Notice: Subject to any disclaimer, the term of this patent is extended or adjusted under 35 U.S.C. 154(b) by 0 days.

(21) Appl. No.: 09/642,472

(22) Filed: Aug. 21, 2000

(30) Foreign Application Priority Data

Aug. 19, 1999 (DE) ..... 199 39 264

(51) Int. Cl.[7] ..... F28F 3/08; F28F 9/02; F28D 1/02

(52) U.S. Cl. ..... 165/167; 165/153; 165/175

(58) Field of Search ..... 165/167, 153, 165/175, 916

(56) References Cited

U.S. PATENT DOCUMENTS

| | | | | |
|---|---|---|---|---|
| 4,708,199 A | * | 11/1987 | Yogo et al. | 165/167 |
| 5,327,958 A | * | 7/1994 | Machata et al. | 165/167 |
| 5,511,612 A | * | 4/1996 | Tajima | 165/167 |
| 5,634,518 A | * | 6/1997 | Burgers | 165/153 |
| 5,794,691 A | | 8/1998 | Evans et al. | |
| 5,931,219 A | * | 8/1999 | Kull | 165/167 |
| 6,182,746 B1 | * | 2/2001 | Wiese | 165/167 |
| 6,182,748 B1 | * | 2/2001 | Brost et al. | 165/167 |

FOREIGN PATENT DOCUMENTS

| | | |
|---|---|---|
| DE | 26 30 808 | 1/1977 |
| DE | 24 04 630 C2 | 8/1982 |
| DE | 38 26 244 A1 | 2/1990 |
| DE | 196 54 365 A1 | 6/1998 |
| DE | 197 22 074 A1 | 12/1998 |

* cited by examiner

*Primary Examiner*—Ira S. Lazarus
*Assistant Examiner*—Tho Van Duong
(74) *Attorney, Agent, or Firm*—Crowell & Moring, LLP

(57) ABSTRACT

A plate heat exchanger, in particular an oil cooler for internal combustion engines, in a stacking mode of construction, provides conduits projecting toward one side for formation of feeding and drainage channels. Each conduit typically is provided with an edge bent inwards and running parallel to the base of the neighboring plate. The collar forming the conduit projects sufficiently far from the base of the plate that the edge projecting inwards can abut the base of the neighboring plate. This configuration reduces the heat exchange surface. To eliminate this problem, instead of collars with an encircling edge projecting only toward one side, collars projecting toward both sides are provided. Each of the collars is formed conically and engages, on stacking, into another of the collars. The collars are formed identically, but on plates which, when set on one another, are turned 180° with respect to the other, thus making simple soldering and simple handling possible.

16 Claims, 2 Drawing Sheets

PLATE HEAT EXCHANGER

This application claims the priority of German application 199 39 264.1, filed Aug. 19, 1999, the disclosure of which is expressly incorporated by reference herein.

BACKGROUND AND SUMMARY OF THE INVENTION

The present invention relates to a plate heat exchanger, in particular an oil cooler for internal combustion engines, having several identical plates formed as dishes which are stacked on one another, each turned by 180°, with their edges adjacent to one another and provided with projecting conduits for the formation of feeding and drainage channels for the heat exchange media.

Plate heat exchangers of this type are known from German publication DE 196 54 365 A1. In such heat exchangers, each of the conduits projecting toward one side consists of a collar projecting perpendicularly from one of the plate surfaces. A free edge of the collar is bent inwards and forms an encircling annular surface which, on stacking of the plates on one another, is adjacent to the edge of an opening disposed in the surface of the neighboring plate. Since the plates are subsequently soldered to one another, there arises in this way a passage channel for one of the heat exchange media which is sealed off from the chamber formed between neighboring plates. However, since the diameter of the encircling collar is greater than the diameter of the opening in the neighboring plates by the thickness of the annular surface formed by the edge bent inwards, the heat exchange surface becomes smaller by this annular surface in the chamber separated from the through-flow conduits. The heat exchange is thus not fully utilized.

It has been found that the soldering between the edge of the collar and the surface of the plate sometimes leaves something to be desired since failures of sealing can arise here.

U.S. Pat. No. 5,794,691 discloses that, for increasing the strength of heat exchangers consisting of dishes set on one another, it is possible to provide connecting tongues bent inwards in the area of each passage channel. The connecting tongues can be connected to one another by their edges and thereby contribute to an increase in stability in the area of the passage. In this configuration, for the formation of the passage channels, conduits projecting toward one side, which are adjacent to one another with annular surfaces, are also provided. This configuration, therefore, suffers from the disadvantage that the heat exchange surface available within the chamber is reduced by the formation of the conduits.

Finally, from German publication DE 197 22 074 A1, it is known, in the case of a plate heat exchanger with heat exchanger plates stacked on one another, to form conically tapering collars projecting out from the surface of the plate for the disposition of fastening elements. The collars, like the outer edges of the individual plates, fit into one another and are soldered so that, in this way, supporting sleeves are formed for the fastening of head bolts to be implemented. In this mode of construction, the passage openings for the heat exchange media are formed according to known practices and the heat exchange surface is reduced, in addition, by the supporting passages for the head bolt.

It is one object of the present invention to form a plate heat exchanger of the type mentioned initially so that the heat exchange surface is enlarged in a simple way and the stability of the entire structure is increased.

This object is achieved by providing, in a plate heat exchanger of the type mentioned initially, at least one conduit that projects in the form of a collar conically expanding toward one side of the surface of the plate and a collar conically tapering toward the opposite side of each plate, disposing the collars on the surface of the plate so that they are aligned to one another after a 180° turn in the plane of the plate, and coordinating their conicity to one another so that they engage in one another at least partially.

By this configuration, the previous simple type of plate heat exchanger structure made by stacking plates on one another can be retained. Since now, however, the collars provided for the formation of the passage openings project toward different sides, they can engage directly in one another when they are put together so that the disposition of annular soldering surfaces bent outwards is superfluous. The surface available for heat exchange within the chambers is thus enlarged. Furthermore, favorable prerequisites for soldering are created.

According to one feature of the invention, four collars are provided. Two of these collars, identically formed, are disposed symmetrically to a longitudinal plane of each plate so that feeding and drainage of the two media participating in the heat exchange in adjacent chambers within the individual plates is made possible. It has, moreover, been shown that it is very advantageous if the conical angle of the collar is positioned to about 8° or 9°. This permits a simple stacking on one another and a tight fit of the collars before soldering.

According to another feature of the invention, the plates can be provided with encircling edges which project toward one side and at least partially reach over the edge of the neighboring plate.

According to yet another feature of the invention, the collars can engage in openings of turbulence inserts which are mounted between each pair of neighboring plates. Here, the openings in the turbulence inserts can be provided with smaller diameters than in the case of plate heat exchangers according to the state of the art. The heat exchange can thus be improved.

Finally, according to yet another feature of the invention, the collars can disposed as near as possible to the edges bordering the narrow sides of the plates. Since the through-flow of the chambers is done from one passage channel to the passage channel lying opposite in the longitudinal direction of the plate and only a negligible part of the flow is done in the area between the outer edge and the collar, the yield of heat exchange can also be improved in this way.

The invention is represented by way of an exemplary embodiment in the drawings and will now be explained.

DESCRIPTION OF THE PREFERRED EMBODIMENT

Figure 1:
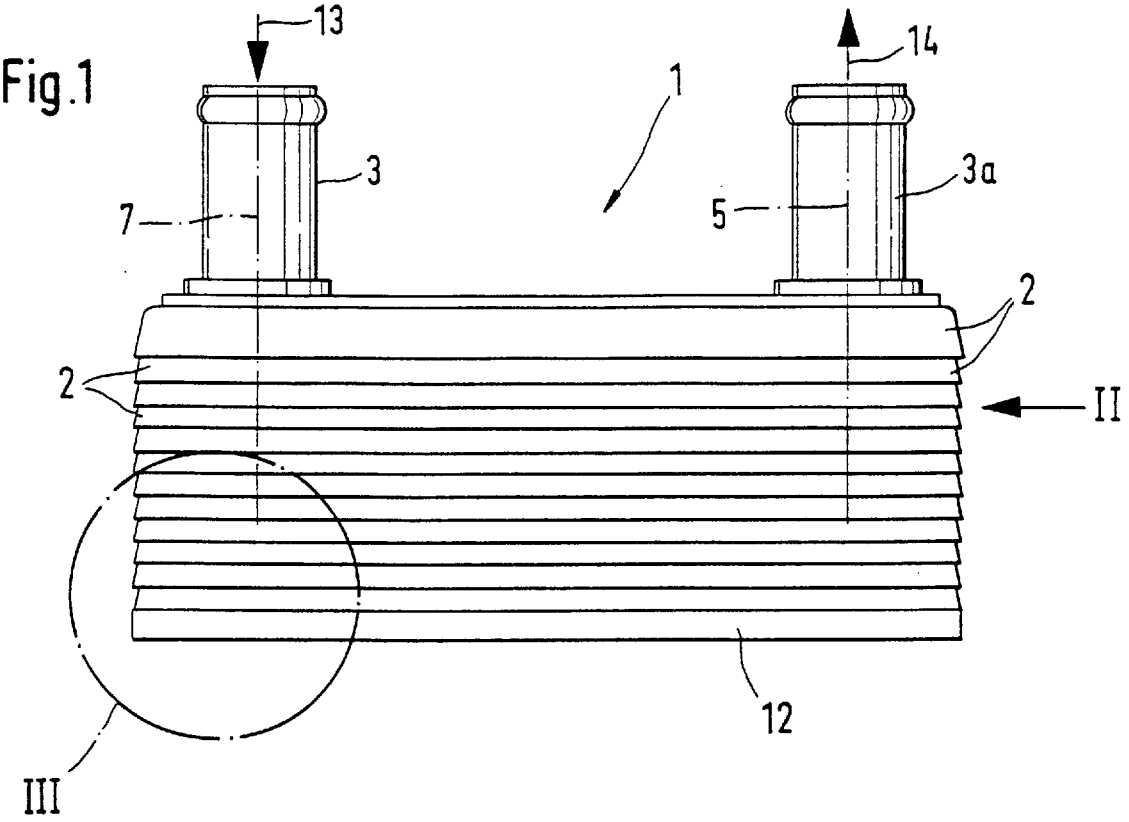
FIG. 1 is a lateral view of a plate heat exchanger according to the invention.
Figure 2:
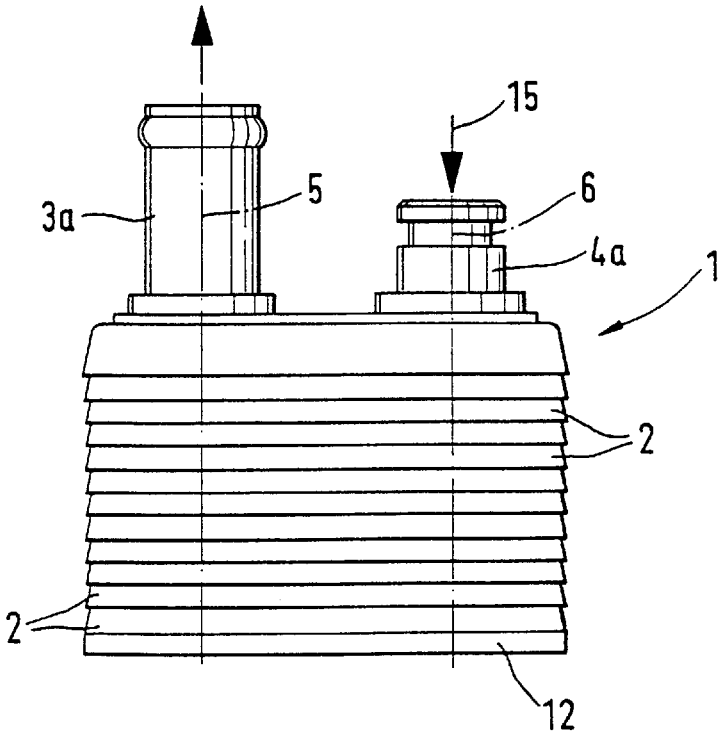
FIG. 2 is a frontal view of the plate heat exchanger of FIG. 1 as seen in the direction of the arrow II.
Figure 3:
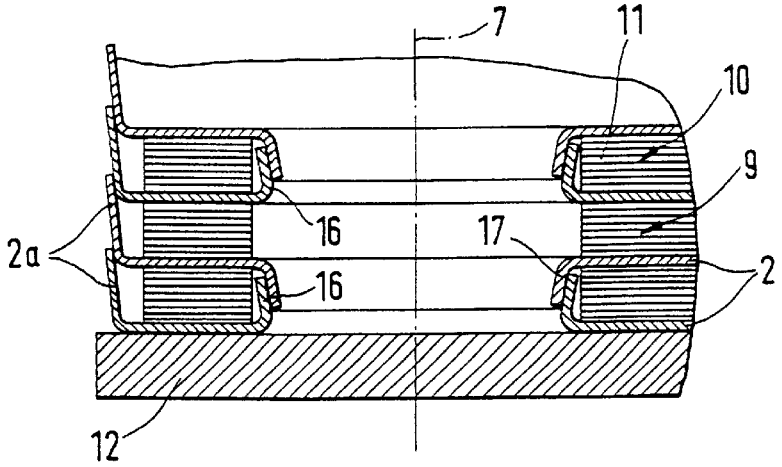
FIG. 3 is an enlarged representation of a section through the plate heat exchanger of FIG. 1 in the area III.

FIGS. 1 to 3 show that a plate heat exchanger 1, which is formed here as an oil cooler for internal combustion engines, is built up of several plates 2, stacked one over another, which are formed as dishes and which, on stacking of one over another, engage over one another with their projecting edges 2*a* (FIG. 3) and are soldered tight to one another. Within these plates 2, chambers 9 and 10 are formed which are each provided with turbulence inserts 11. The plates 2 stacked one over another are closed off by a base plate 12. The feeding and drainage of the heat exchange media is done by the feeding and drainage conduits 3, 3*a* or 4, 4*a;* the conduit 4 corresponds to the conduit 4*a* shown in FIG. 2 but, in FIG. 2, lies behind the conduit 4*a* and, in FIG. 1, lies behind the conduit 3. The conduits 3, 3*a* are pressurized with one of the heat exchange media flowing through in the direction of the arrow 13 or 14. The second heat exchange medium flows in the direction of the arrow 15 (FIG. 2) and out once again at the conduit 4 (which is not represented). As heat exchange media, for example, the coolant of a motor and cooling motor oil can be provided.

Figure 4:
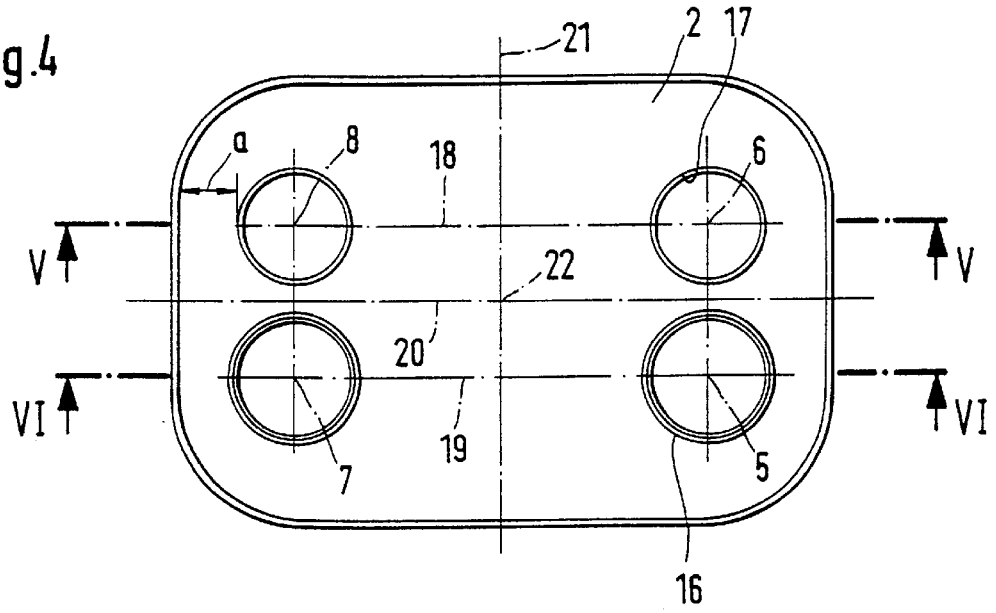
FIG. 4 is a plan view of one of the plates used for constructing the plate heat exchanger according to FIGS. 1 to 3.
Figure 5:
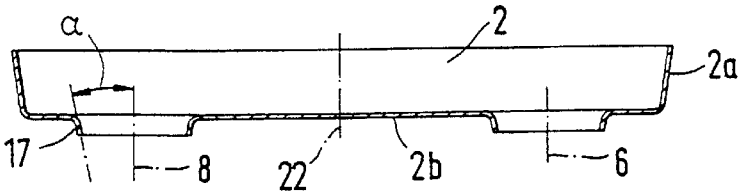
FIG. 5 is a section through the plate of FIG. 4 as seen along line V—V.
Figure 6:
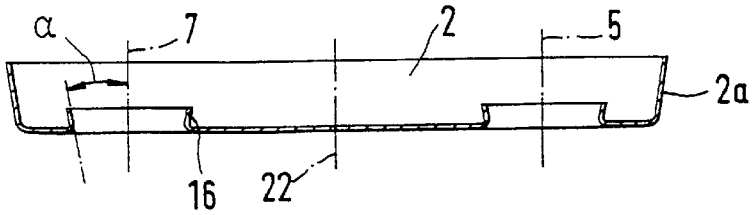
FIG. 6 is a section through the plate of FIG. 4 as seen along line VI—VI.

Within the individual plates 2, feeding and drainage channels are formed along each of the axes of through-flow 5, 6, 7, and 8 which are drawn in once again in FIG. 4. These feeding and drainage channels are then formed, as is clear from FIG. 3, by the collars 16 or 17 which project from the individual plates 2 concentrically with respect to the respective feeding and drainage axes. The collars 16 are formed as collars expanding to their edges. These collars 16 project, as FIG. 6 particularly shows, into the interior of each of the dishes 2. The collars 17, on the other hand, project from the substantially plane base of the dish outwards. The central axes of the collars 16, on the one hand, and the collars 17, on the other hand, are disposed in planes 19 or 18 which run parallel to one another and parallel to the central longitudinal axis 20 of the plate 2. They are, moreover, also disposed symmetrically to the central transverse plane 21 so that one collar 17 can come into engagement with each of the collars 16 if neighboring plates 2 are each turned about their central axis 22 by 180° with respect to one another. The conical angle $\alpha$ of the collars 16 and 17 is in this case equally large and is preferably 8° to 9°. It has been shown that this inclination yields particularly good soldering and provides for simple handling during the stacking process. Since all the plates 2 are formed identically to one another, they adapt with their collars and according to their corresponding alignment also with the collars 16 and 17 into one another. In this way, the through-flow openings for the heat exchange media can be created. FIG. 3 makes it clear in this case that the chamber 9 is connected to the through-flow by the channel running along the axis 7. However, FIG. 3 also shows that the heat exchange surfaces determined by the turbulence inserts 11 can be led up to the stop formed by the collar 16 because no soldering surfaces running parallel to the base 2*b* are necessary for connecting neighboring plates to one another.

The collars 16 and 17 are furthermore disposed so that the distance a to the edge running on the narrow sides of the plates 2 becomes as small as possible. This distance a is determined by the thermoforming process typically used for the production of the plates 2. If this distance a is chosen as small as possible, then the through-flow interval between feeding and drainage channels associated with one another, for example between the channels 7 and 5, is as large as possible. The area between the feeding channels which lies at a distance a from the edge is only slightly flown through as a rule and does not contribute much to the heat exchange.

However, FIG. 3 also makes it clear that a gap suitable for soldering can be formed by overlapping the collars 16 and 17. This gap, like the overlapping edges 2*a,* also contributes to providing sufficient stability to the entire plate heat exchanger.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

We claim:

1. Plate heat exchanger comprising:

several identical plates formed as dishes which are stacked on one another, each turned by 180°, with edges of said plates adjacent to one another, projecting conduits provided on the plates for formation of feeding and drainage channels for heat exchange media, said conduits being adjacent to an associated surface of a neighboring plate, wherein at least one conduit for each plate is formed by a collar which projects and conically expands away from one side surface of a base of the plate and another conduit is formed by a collar which projects and conically tapers away from an opposite side surface of the base of the plate, wherein the collars are disposed on the base of the plate so that they are aligned to one another after a 180° turn about a central axis of the plate, and wherein conicity of the collars is coordinated to one another so that they engage in one another at least partially.

2. Plate heat exchanger according to claim 1 wherein four collars are provided for each plate and wherein two of said collars, identically formed, are disposed symmetrically with respect to the central transverse plane of the plate.

3. Plate heat exchanger according to claim 1 wherein an angle of conicity of the collars is about 8° or 9°.

4. Plate heat exchanger according to claim 1 wherein the plates are provided with encircling edges which project toward one side and at least partially reach over edges of the neighboring plates.

5. Plate heat exchanger according to claim 1 wherein the collars can engage in openings of turbulence inserts which are mounted between each pair of neighboring plates.

6. Plate heat exchanger according to claim 1 wherein a minimum distance of the collars from edges bordering narrow sides of the plates is chosen.

7. Plate heat exchanger according to claim 2 wherein an angle of conicity of the collars is about 8° or 9°.

8. Plate heat exchanger according to claim 2 wherein the plates are provided with encircling edges which project toward one side and at least partially reach over edges of the neighboring plates.

9. Plate heat exchanger according to claim 3 wherein the plates are provided with encircling edges which project toward one side and at least partially reach over edges of the neighboring plates.

10. Plate heat exchanger according to claim 2 wherein the collars can engage in openings of turbulence inserts which are mounted between each pair of neighboring plates.

11. Plate heat exchanger according to claim 3 wherein the collars can engage in openings of turbulence inserts which are mounted between each pair of neighboring plates.

12. Plate heat exchanger according to claim 4 wherein the collars can engage in openings of turbulence inserts which are mounted between each pair of neighboring plates.

13. Plate heat exchanger according to claim 2 wherein a minimum distance of the collars from edges bordering narrow sides of the plates is chosen.

14. Plate heat exchanger according to claim 3 wherein a minimum distance of the collars from edges bordering narrow sides of the plates is chosen.

15. Plate heat exchanger according to claim 4 wherein a minimum distance of the collars from edges bordering narrow sides of the plates is chosen.

16. Plate heat exchanger according to claim 5 wherein a minimum distance of the collars from edges bordering narrow sides of the plates is chosen.

* * * * *